US008952951B2

(12) United States Patent
Yoo et al.

(10) Patent No.: US 8,952,951 B2
(45) Date of Patent: Feb. 10, 2015

(54) ORGANIC LIGHT EMITTING DISPLAY AND DRIVING METHOD THEREOF

(75) Inventors: Myoung-Hwan Yoo, Yongin (KR); Choon-Yul Oh, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 1072 days.

(21) Appl. No.: 12/888,115

(22) Filed: Sep. 22, 2010

(65) Prior Publication Data

US 2011/0216056 A1 Sep. 8, 2011

(30) Foreign Application Priority Data

Mar. 2, 2010 (KR) ..... 10-2010-0018685

(51) Int. Cl.
*G09G 3/30* (2006.01)
*G09G 5/00* (2006.01)
*G09G 3/32* (2006.01)

(52) U.S. Cl.
CPC ... *G09G 3/32* (2013.01); *G09G 5/00* (2013.01)
USPC ..... 345/212; 345/78; 345/204

(58) Field of Classification Search
USPC ..... 345/76–83, 204–215; 315/169.1–169.4
See application file for complete search history.

(56) References Cited

U.S. PATENT DOCUMENTS

2007/0035487 A1* 2/2007 Ryu et al. ..... 345/76
2007/0296671 A1 12/2007 Han et al.
2009/0051628 A1* 2/2009 Kwon ..... 345/77
2009/0213046 A1* 8/2009 Nam ..... 345/76
2009/0303227 A1 12/2009 Hwang
2010/0123699 A1 5/2010 Leon et al.
2011/0210958 A1* 9/2011 Yoo et al. ..... 345/214

FOREIGN PATENT DOCUMENTS

KR 10-2008-0008253 1/2008
KR 10-0858615 9/2008
KR 1020090020190 2/2009

* cited by examiner

*Primary Examiner* — Kent Chang
*Assistant Examiner* — Nelson Rosario
(74) *Attorney, Agent, or Firm* — Robert E. Bushnell, Esq.

(57) ABSTRACT

An organic light emitting diode display that includes pixels having organic light emitting diodes and driving transistors for supplying a driving current to the respective organic light emitting diodes. Also included is a compensator for receiving a predetermined voltage applied to a gate electrode of the respective driving transistors, finding a threshold voltage, mobility, and a change of mobility of the driving transistors, and determining a compensation amount caused by an input image data signal while sinking a predetermined current to a path of a driving current to the organic light emitting diode through a data line connected to the pixels. Further included is a timing controller for receiving the compensation amount, correcting the input image data signal, and transmitting the corrected image data signal and a data driver for generating a data voltage based on the corrected image data signal, and supplying the data voltage to the pixels.

21 Claims, 9 Drawing Sheets

ORGANIC LIGHT EMITTING DISPLAY AND DRIVING METHOD THEREOF

CLAIM OF PRIORITY

This application makes reference to, incorporates the same herein, and claims all benefits accruing under 35 U.S.C. §119 from an application earlier filed in the Korean Intellectual Property Office on Mar. 2, 2010 and there duly assigned Serial No. 10-2010-0018685.

BACKGROUND OF THE INVENTION

1. Field of the Invention

The general inventive concept relates to an organic light emitting diode (OLED) display and a driving method thereof.

2. Description of the Related Art

Various kinds of flat display devices that are capable of reducing the detriments and disadvantages of cathode ray tubes (CRT), such as their heavy weight and large size, have been developed in recent years. Such flat display devices include liquid crystal displays (LCDs), field emission displays (FEDs), plasma display panels (PDPs), and organic light emitting diode (OLED) displays.

Among the above flat panel displays, the OLED display using an organic light emitting diode (OLED) generating light by a recombination of electrons and holes for the display of images has a fast response speed, is driven with low power consumption, and had excellent luminous efficiency, luminance, and viewing angle, such that it has been spotlighted.

The above information disclosed in this Related Art section is only for enhancement of understanding of the background of the invention and therefore it may contain information that does not form the prior art that is already known in this country to a person of ordinary skill in the art.

SUMMARY OF THE INVENTION

Aspects of the present invention provide for an organic electro-luminescence display device for compensating luminance deterioration caused by deterioration of an organic light emitting diode (OLED), and displaying images of uniform luminance irrespective of threshold voltage/mobility of a driving transistor included in a pixel.

Aspects of the present invention provide for a method for correcting the limit of existing mobility compensation and the mismatch of current per pixel by the corrected pixel data.

An exemplary embodiment of the present invention provides for an organic light emitting diode display including: a plurality of pixels including a plurality of organic light emitting diodes and a plurality of driving transistors for supplying a driving current to the respective organic light emitting diodes; a compensator for receiving a predetermined voltage applied to a gate electrode of the respective driving transistors, finding a threshold voltage, mobility, and a change of mobility of the driving transistors, and determining a compensation amount caused by an input image data signal while sinking a predetermined current to a path of a driving current to the organic light emitting diode through a data line connected to the pixels; a timing controller for receiving the compensation amount, correcting the input image data signal, and transmitting the corrected image data signal; and a data driver for generating a data voltage based on the corrected image data signal, and supplying the data voltage to the pixels.

The compensator further may include at least one current sinker for sinking the predetermined current; a controller for finding the threshold voltage, mobility, and mobility deviation, and determining the compensation amount; and a memory for receiving and storing the predetermined voltage and storing the determined compensation amount, and the compensator receives each driving voltage of the organic light emitting diodes through corresponding data lines while supplying a predetermined third current to the organic light emitting diodes through the data lines connected to the pixels, and determines a compensation amount caused by each deterioration degree of the organic light emitting diodes according to the driving voltages.

The current sinker may include a first current sinker for sinking a predetermined first current and a second current sinker for sinking a second current having a current value that is less than the first current, the first current represents a current value flowing to the organic light emitting diode when the organic light emitting diode emits light with the maximum luminance, a first voltage and a second voltage are applied to each gate electrode of a plurality of driving transistors while the first current and the second current are sunk, each of the threshold voltage and mobility of the driving transistors are calculated from the first voltage and the second voltage, and the compensation amount represents a voltage value corresponding to the driving voltage that is increased by deterioration of the organic light emitting diodes.

The compensator may further include a current source for supplying the third current.

The organic light emitting diode display may further include a selector between the compensator, the data driver, and the pixels, and the selector includes: a plurality of data selecting switches connected to data lines connected to the pixels; a plurality of compensator selecting switches connected to a node of a plurality of compensation lines divided by the data lines; and a selecting driver for generating and transmitting a plurality of selection signals for controlling the data selecting switches and the compensator selecting switches.

The pixels may respectively include: a plurality of first transistors provided between electrodes of the organic light emitting diodes and the data lines connected to the pixels; and a plurality of second transistors provided between the data lines connected to the pixels and the gate electrodes of the driving transistors.

While the first transistors and the second transistors are turned on, a predetermined current is sunk and a predetermined voltage applied to the gate electrodes of the driving transistors is transmitted to the compensator, while the first transistors are turned on and the second transistors are turned off, a predetermined current is supplied and the driving voltages of the organic light emitting diodes are transmitted to the compensator, and while the first transistors are turned off and the second transistors are turned on, the data voltage based on the corrected image data signal is supplied to a plurality of pixels.

Yet another embodiment of the present invention provides a method for driving an organic light emitting diode display, including: receiving a predetermined voltage applied to gate electrodes of a plurality of driving transistors while sinking a predetermined current to a path of a driving current to an organic light emitting diode by passing through the driving transistors included in the pixels through data lines corresponding to the pixels; finding threshold voltage, mobility, and mobility deviation of the driving transistors by using the predetermined voltage, and determining a compensation amount caused by an input image data signal; and correcting the input image data signal based on the compensation amount, generating a data voltage according to the corrected image data signal, and transmitting the data voltage to the pixels.

The receiving of a predetermined voltage may include sinking a first current, and receiving a first voltage applied to gate electrodes of the driving transistors; and sinking a second current having a current value that is less than the first current, and receiving a second voltage applied to the gate electrodes of the driving transistors.

The first current indicates a current value flowing to the organic light emitting diode when the organic light emitting diode emits light with the maximum luminance, and the method further includes, before or after the receiving of a predetermined voltage, supplying a predetermined third current to a plurality of organic light emitting diodes included in the pixels through the data lines corresponding to the pixels, and receiving driving voltages of the organic light emitting diodes; and determining a compensation amount caused by deterioration degrees of the organic light emitting diodes according to the received driving voltage.

The receiving of a predetermined voltage through data lines corresponding to the pixels and transmitting the data voltage caused by the corrected image data signal to the pixels may be controlled by a switching operation of a selector including a plurality of data selecting switches connected to the data lines and a plurality of compensator selecting switches connected to a node of a plurality of compensation lines divided by the data lines.

The selector may further include a selecting driver for generating and transmitting a plurality of selection signals for controlling switching operations of the data selecting switches and the compensator selecting switches.

While the receiving of a predetermined voltage is performed, driving transistors of the pixels, first transistors of the pixels connected between electrodes of the organic light emitting diodes and the corresponding data lines, and second transistors of the pixels connected between the corresponding data lines and gate electrodes of the driving transistors are turned on, and while the generating and transmitting of a data voltage caused by the corrected image data signal to a plurality of pixels is performed, first transistors of the pixels connected between electrodes of the organic light emitting diodes and the corresponding data lines are turned off, and the driving transistors of the pixels and second transistors of the pixels connected between the corresponding data lines, and the gate electrodes of the driving transistors are turned on.

According to an embodiment of the present invention, image quality is improved by preventing non-uniformity and deviation of luminance caused by non-uniformity of a threshold voltage of transistors of pixels and deviation of electron mobility in an organic light emitting diode (OLED) display.

Further, according to an embodiment of the present invention, a screen can be displayed with desired luminance irrespective of deterioration of an organic light emitting diode (OLED) by quickly detecting deterioration of an organic light emitting diode (OLED) included in the pixels of an organic light emitting diode (OLED) display in real-time and compensating the same. In addition, desired black luminance can be obtained by overcoming the problem of quickly sensing deterioration of an organic light emitting diode (OLED) and simultaneously realizing achievement of black luminance.

According to an embodiment of the present invention, since compensation data are determined by a new equation, that is, the data voltage is generated by the gamma value controlled by mobility of the driving transistor, it is possible to obtain many quality panels because of the increased TFT's mobility error compensation range and by keeping a table or a logical expression for mobility variation.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
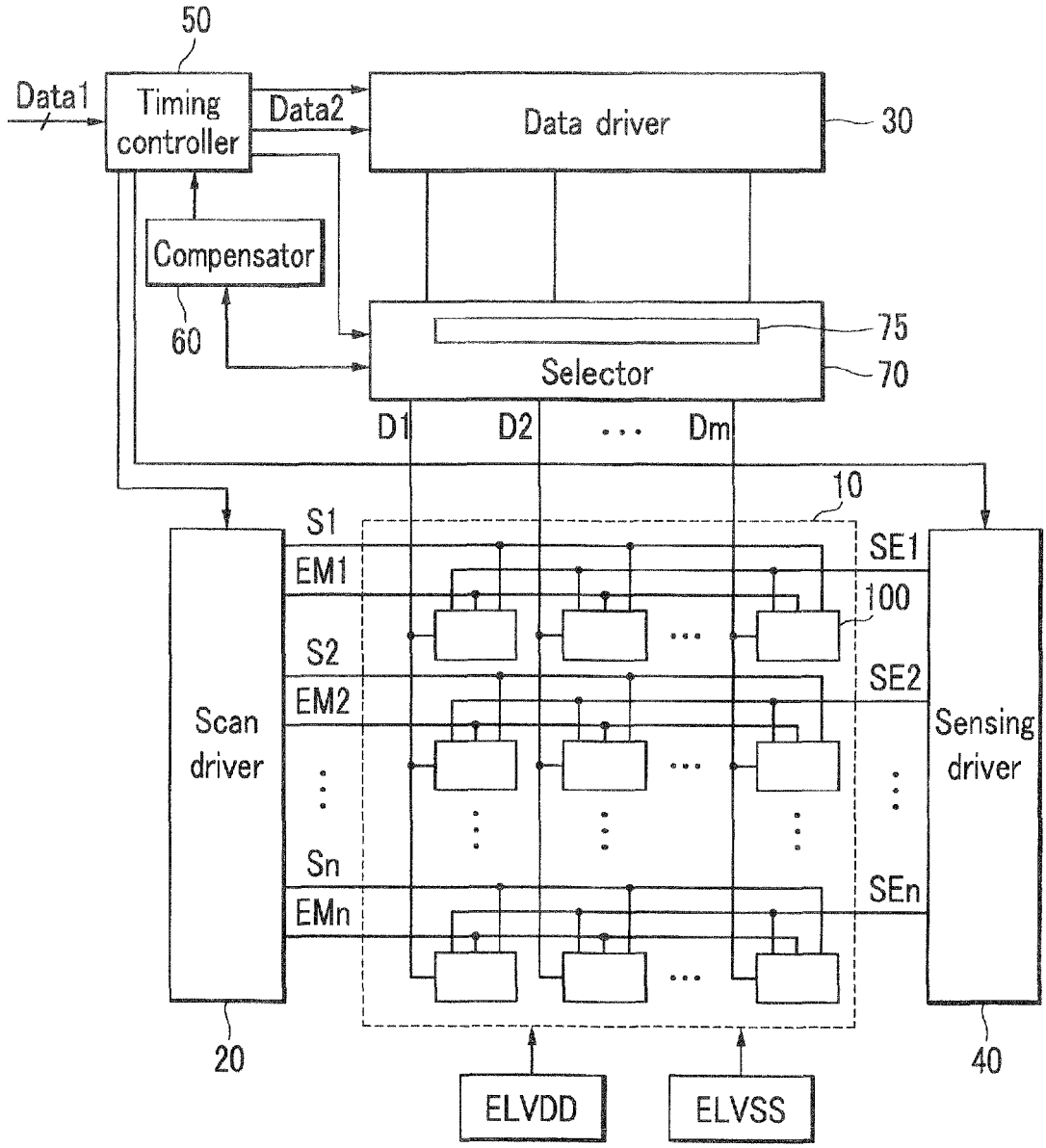
FIG. 1 is a block diagram of an organic light emitting diode (OLED) display according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Constituent elements having the same structures throughout the embodiments are denoted by the same reference numerals and are described in a first embodiment. In the other embodiments, only constituent elements other than the same constituent elements will be described.

In addition, parts not related to the description are omitted for clear description of the present invention, and like reference numerals designate like elements and similar constituent elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

As those skilled in the art would realize, the described embodiments may be modified in various different ways, all without departing from the spirit or scope of the principles for the present invention.

Recognizing that sizes and thicknesses of constituent members shown in the accompanying drawings are arbitrarily given for better understanding and ease of description, the present invention is not limited to the illustrated sizes and thicknesses.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. Alternatively, when an element is referred to as being "directly on" another element, there are no intervening elements present.

Generally, the conventional organic light emitting diode (OLED) display is classified into a passive matrix OLED (PMOLED) and an active matrix OLED (AMOLED) according to the driving method of the organic light emitting diode (OLED).

The passive matrix uses a method in which an anode and a cathode are formed to cross each other and cathode lines and anode lines are selectively driven, and the active matrix uses a method in which a thin film transistor and a capacitor are integrated in each pixel and a voltage is maintained by a capacitor. The passive matrix type has a simple structure and a low cost, however it is difficult to manufacture a panel of a large size or high accuracy. In contrast, with the active matrix type it is possible to manufacture a panel of a large size or high accuracy, however it is difficult to technically realize the control method thereof and a comparatively high cost is required.

With regard to resolution, contrast, and operation speed, the current trend is toward the organic light emitting diode display (AMOLED) of the active matrix type where respective unit pixels selectively turn on or off.

However, the luminous efficiency is decreased by deterioration of the organic light emitting diode (OLED) such that the light emitting luminance is decreased for the same current.

Also, the current flowing in the organic light emitting diode (OLED) according to the same data signal is changed by non-uniformity of the threshold voltage of the driving transistor controlling the current flowing in the organic light emitting diode (OLED) and a deviation of the electron mobility.

The deterioration of the organic light emitting diode (OLED) results in image sticking, and the characteristic deviation of the driving transistor results in mura (unevenness).

Particularly, regarding the problem of non-uniformity of mobility, the existing compensation method has a limit and hence the corrected pixel data fail to accurately match current per pixel and generates an error.

FIG. 1 is a block diagram of an organic light emitting diode (OLED) display according to an exemplary embodiment of the present invention.

The organic light emitting diode (OLED) display includes a display 10, a scan driver 20, a data driver 30, a sensing driver 40, a timing controller 50, a compensator 60, and a selector 70.

The display 10 may include a plurality of pixels 100 arranged thereon, and each pixel 100 may include an organic light emitting diode (OLED) (refer to FIG. 3) for emitting light corresponding to a flow of driving current according to a data signal transmitted from the data driver 30.

Further illustrated in the Figures are a plurality of scan lines S1, S2, . . . , Sn for transmitting scan signals, a plurality of emission control lines EM1, EM2, . . . , EMn for transmitting light emission control signals, and a plurality of sensing lines SE1, SE2, . . . , SEn for transmitting sensing signals are formed in the row direction on the pixels 100. Also, a plurality of data lines D1, D2, . . . , Dm arranged in a column direction and transmitting data signals are formed on the pixels 100. The plurality of data lines D1, D2, . . . , Dm can selectively further transmit a driving voltage of the organic light emitting diode (OLED) caused by deterioration of the organic light emitting diode included in the pixel 100, a threshold voltage of a driving transistor M1, and a voltage at a gate electrode of the driving transistor M1 for calculating mobility in addition to the corresponding data signals.

The display 10 receives a first power source voltage ELVDD and a second power source voltage ELVSS for supplying driving current to the pixels from a power supply (not shown).

The scan driver 20 for applying the scan signals to the display 10 may be connected to the scan lines S1, S2, . . . , Sn and transmits the scan signals to the corresponding scan lines.

Also, the scan driver 20 for applying the light emission control signals to the display 10 may be connected to the emission control lines EM1, EM2, . . . , EMn, and transmits the light emission control signals to the corresponding emission control lines.

The scan driver 20 is described in the exemplary embodiment of the present invention to generate and transmit the light emission control signals together with the scan signals, and the present invention is not limited thereto. That is, a display device according to another exemplary embodiment of the present invention can additionally include a light emission control driver.

The sensing driver 40 for applying the sensing signals to the display 10 may be connected to the sensing lines SE1, SE2, . . . , SEn, and transmits the sensing signals to the corresponding sensing lines.

The data driver 30 for transmitting the data signals to the display 10 receives the image data signals from the timing controller 50 to generate a plurality of data signals, and transmits the data signals to the corresponding data lines D1, D2, . . . , Dm in synchronization with the time when the scan signals are transmitted to the corresponding scan lines. The data signals output by the data driver 30 are transmitted to the pixels of one row to which the scan signal may be transmitted among the pixels 100 of the display 10. The driving current following the corresponding data signals flows to the organic light emitting diodes (OLEDs) of the pixels.

The compensator 60 detects a driving voltage of the plurality of organic light emitting diodes (OLEDs) respectively included in the pixels, accordingly senses the deterioration (hereinafter, a deterioration degree) of the organic light emitting diodes (OLEDs), and determines a data signal compensation amount for compensating the sensed deterioration degree. Here, the data signal compensation amount is determined by the sensed deterioration degree and the data signal.

Also, the compensator 60 senses the voltages at the gate electrodes of the plurality of driving transistors M1 included in the pixels 100, and respectively calculates the threshold voltage and the mobility of the driving transistors M1 to compensate the deviation for the threshold voltage and the mobility of the driving transistors M1.

The compensator 60 determines the data signal compensation amount based on the calculated threshold voltage and mobility of the driving transistors M1 so that the organic light emitting diode (OLED) may emit light with the target luminance corresponding to the data signal irrespective of the deviation of the threshold voltage and mobility. The target luminance occurs when the current that is generated when the corresponding data signal is transmitted to the driving transistor having the threshold voltage and the mobility set as reference flows to the organic light emitting diode (OLED).

The compensator 60 stores the data signal compensation amounts respectively corresponding to the plurality of image data signals for the respective organic light emitting diodes of the pixels 100. The compensator 60 transmits the data signal compensation amount to the timing controller 50, and the timing controller 50 adds the corresponding data signal compensation amount to the image data signal corresponding to the image signal to generate the compensated image data signal. In detail, the image data signal can be a digital signal arranged in series by 8-bit digital signals for representing a grayscale of a pixel. The timing controller 50 adds a corresponding data signal compensation amount to the respective 8-bit digital signals to generate a digital signal of a different number of bits, for example, a 10-bit digital signal. The image data signal then becomes a signal of 10-bit digital signals in series.

The selector 70 includes a plurality of selecting switches (not shown, referred to as data selecting switches) connected to the data lines D1, D2, . . . , Dm, a plurality of selecting switches (not shown, referred to as compensator selecting switches) for connecting a plurality of compensation lines 73 branched from the data lines D1, D2, . . . , Dm to the compensator 60, and a selection driver 75 for generating and transmitting a plurality of selection signals for controlling the data selecting switches and the compensator selecting switches.

The data selecting switches transmit the data signals output by the data driver 30 to the plurality of data lines during the period in which the display device displays the images (hereinafter, referred to as an image display period). That is, the data selecting switches are turned on during the image display period.

The compensator selecting switches respectively connect the data lines to the compensator 60 during a period for measuring the driving voltage of the organic light emitting diode (OLED) and a period for receiving the gate voltages of the plurality of driving transistors M1 to calculate the characteristic deviation of the threshold voltage (hereinafter, a sum of two periods will be referred to as a sensing period). The compensator selecting switches are turned off during the image display period. Also, the compensator selecting switches are sequentially turned on during the sensing period.

The selection driver 75 may receive the selection driving control signal from the timing controller 50 to generate a plurality of first selection signals for controlling the switching operation of the plurality of data selecting switches or a plurality of second selection signals for controlling the switching operation of the plurality of compensator selecting switches. The selector 70 corresponding to the driving timing according to an exemplary embodiment of the present invention will be described in detail with reference to FIG. 2.

Since the data selecting switches are turned on by the plurality of first selection signals during the image display period, the pixels included in a predetermined pixel row among the plurality of pixels emit light according to the driving current caused by the data signal transmitted by the corresponding data lines.

During the sensing period, the compensator selecting switches are sequentially turned on by the second selection signals. While the sensing signals are transmitted to a predetermined pixel row, a plurality of compensation lines 73 branched from the data lines are connected to the compensator 60 through the compensator selecting switches that are sequentially turned on. The pixels of the pixel column to which the sensing signal is transmitted are connected to the compensator 60. The above-described operation is repeated for the sensing lines and the pixels 100 of the corresponding pixel column. Accordingly, information on the pixels 100 to which the sensing signals are transmitted is transmitted to the compensator 60 according to the corresponding second selection signal. Here, the information on the pixel includes the driving voltage of the organic light emitting diode (OLED), the mobility, and the voltage at the gate electrode of the driving transistor M1.

The timing controller 50 is connected to the scan driver 20, the data driver 30, the sensing driver 40, and the selection driver 75 included in the selector 70, and receives a video signal, a synchronic signal, and a clock signal to generate and transmit control signals for controlling the scan driver 20, the data driver 30, the sensing driver 40, and the selection driver 75 included in the selector 70.

The timing controller 50 receives image signals (RGB image signals) including red, blue, and green signals, and generates image data signals by using the data signal compensation amount transmitted by the compensator 60.

Here, the timing controller 50 generates the image data signal by applying the threshold voltage of the driving transistor M1, the mobility, and the data signal compensation amount for compensating the deviation for the driving voltage of the organic light emitting diode (OLED) to the image signal. The image data signal is transmitted to the data driver 30, and the data driver 30 transmits the data signals according to the image data signal to the pixels of the display 10. All pixels emit light by the threshold voltage of the driving transistors M1, the deviation of mobility, and the current of which deviation caused by deterioration of the organic light emitting diode (OLED) is compensated.

A partial configuration of the organic light emitting diode (OLED) display and a circuit diagram of a pixel according to an exemplary embodiment of the present invention will be described in detail with reference to FIG. 2.

Figure 2:
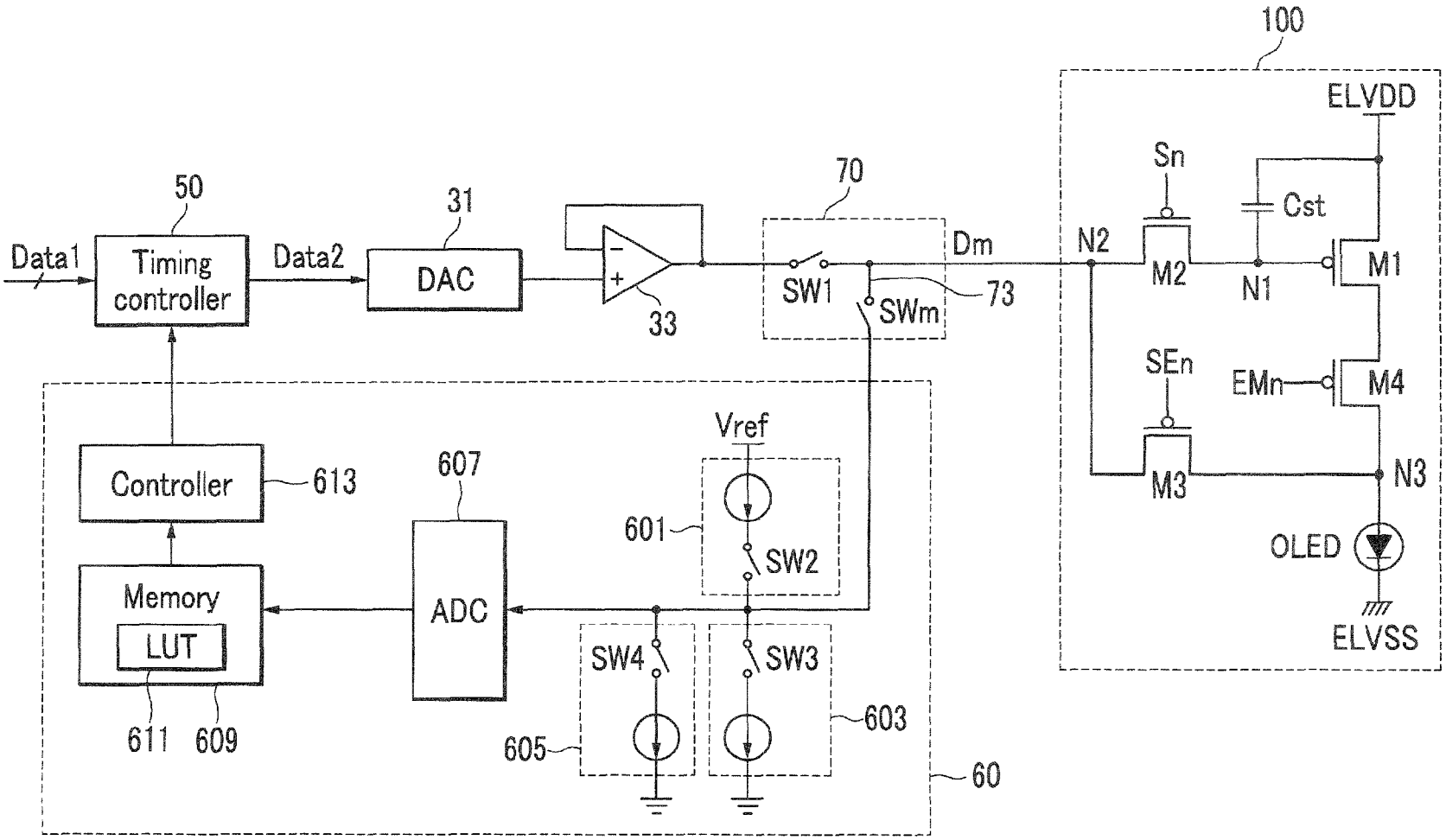
FIG. 2 is a circuit diagram of a partial configuration and a pixel shown in FIG. 1 according to an exemplary embodiment of the present invention.

FIG. 2 shows a detailed partial configuration including the compensator 60 in the organic light emitting diode (OLED) display shown in FIG. 1, and also shows a circuit diagram of a pixel 100 that is connected to a corresponding data line Dm from among a plurality of data lines.

FIG. 2 is a circuit diagram of a pixel 100 at a position that corresponds to an n-th pixel row and an m-th pixel column from among a plurality of pixels included in the display 10 shown in FIG. 1.

The pixel 100 includes an organic light emitting diode (OLED), a driving transistor M1, a first transistor M3, a second transistor M2, a third transistor M4, and a storage capacitor Cst.

The pixel 100 may include an organic light emitting diode (OLED) for emitting light according to driving current applied to the anode, and a driving transistor M1 for transmitting driving current to the organic light emitting diode (OLED).

The driving transistor M1, provided between the anode of the organic light emitting diode (OLED) and the first power source voltage (ELVDD), controls current flowing from the first power source voltage (ELVDD) to the second power source voltage (ELVSS) through the organic light emitting diode (OLED).

In detail, a gate of the driving transistor M1 may be connected to a first end of the storage capacitor Cst, and a first electrode thereof is connected to a second end of the storage capacitor Cst and the first power source voltage (ELVDD). The driving transistor M1 controls the driving current flowing to the organic light emitting diode (OLED) from the first power source voltage (ELVDD) corresponding to the voltage value according to the data signal stored in the storage capacitor Cst. In this instance, the organic light emitting diode (OLED) emits light corresponding to the driving current supplied by the driving transistor M1.

The first transistor M3, provided between the anode of the organic light emitting diode (OLED) and a data line Dm connected to the pixel 100 from among a plurality of data lines, receives a driving voltage of the organic light emitting diode (OLED) from the organic light emitting diode (OLED).

In detail, a gate of the first transistor M3 may be connected to the sensing line (SEn) connected to the pixel 100 from among a plurality of sensing lines, the first electrode may be connected to the anode of the organic light emitting diode (OLED), and the second electrode may be connected to the data line Dm from among a plurality of data lines. The first transistor M3 is turned on when the sensing signal of the gate on voltage level may be supplied to the sensing line (SEn), and it is turned off in other cases. The sensing signal may be supplied during the sensing period.

The second transistor M2 may be connected to the scan line (Sn) connected to the pixel 100 from among a plurality of scan lines and the data line Dm connected to the pixel 100 from among the plurality of data lines, and transmits the data signal to the driving transistor M1 in response to the scan signal transmitted by the scan line (Sn).

In detail, a gate of the second transistor M2 may be connected to the scan line (Sn) from among a plurality of scan lines, the first electrode may be connected to the corresponding data line Dm from among a plurality of data lines, and the second electrode may be connected to the gate of the driving transistor M1. The second transistor M2 may be turned on when the scan signal of the gate on voltage level may be supplied to the scan line (Sn), and it may be turned off in other cases. The scan signal has an on voltage level when the voltage at the gate electrode of the driving transistor M1 is sensed in the compensator 60 from among the sensing period and when a predetermined data signal is transmitted from the data line Dm.

The third transistor M4 is provided between the anode of the organic light emitting diode (OLED) and the driving transistor M1, is connected to the emission control line (EMn) connected to the pixel 100 from among a plurality of emission control lines, and controls light emission of the organic light emitting diode (OLED) in response to the light emission control signal transmitted by the emission control line (EMn).

In detail, a gate electrode of the third transistor M4 is connected to the corresponding emission control line (EMn) from among a plurality of emission control lines, the first electrode may be connected to the second electrode of the driving transistor M1, and the second electrode is connected to the anode of the organic light emitting diode (OLED). The third transistor M4 may be turned on when a light emission control signal of the gate on voltage level is supplied to the emission control line (EMn), and it may be turned off in other cases.

The storage capacitor Cst has a first end connected to the gate electrode of the driving transistor M1 and a second end connected to the first electrode and the first power source voltage (ELVDD) of the driving transistor M1.

When the data signal is transmitted to the storage capacitor Cst from the data line Dm, a voltage at a first node N1 where the first end of the storage capacitor Cst and the gate electrode of the driving transistor meet is changed corresponding to the data signal. When the driving transistor M1 and the third transistor M4 may be turned on to form a current path from the first power (ELVDD) to the cathode of the organic light emitting diode (OLED), the current corresponding to the voltage that corresponds to the difference between the voltage value Vgs of the driving transistor M1, that is, the voltage of the data signal that is applied to the gate electrode of the driving transistor M1 and the voltage (ELVDD) at the first electrode, is applied to the organic light emitting diode (OLED), and the organic light emitting diode (OLED) emits light corresponding to the applied current.

The compensator 60 shown in FIG. 2 is connected to the timing controller 50 and the selector 70, and the selector 70 connects the data driver to the pixel 100 together with the compensator 60. The pixel 100 of FIG. 2 represents one corresponding pixel from among all pixels configuring the display 10, and the compensation process and driving by the compensator 60, the timing controller 50, the selector 70, and the data driver included in the organic light emitting diode (OLED) display according to an exemplary embodiment of the present invention are performed for all pixels of the display 10.

FIG. 2 shows a data selecting switch SW1 and compensator selecting switch SWm connected to the data line Dm connected to the pixel 100 from among a plurality of data selecting switches and a plurality of compensator selecting switches of the selector 70. In this instance, the diverged line branched from the data line represents a compensation line 73.

When the compensator selecting switch (SWm) is turned on during the sensing period, the pixel 100 may be sensed through the data line Dm by the compensator selecting switch (SWm). The corresponding data line may be connected to a current source 601, a first current sinker 603, and a second current sinker 605 of the compensator 60. The current source 601 may be controllable by the first switch SW2, the first current sinker 603 may be controllable by the second switch SW3, and the second current sinker 605 may be controllable by the third switch SW4.

The first switch SW2, the second switch SW3, and the third switch SW4 can be commonly connected to one node, and the voltage at the node may be transmitted to an analog digital converter (ADC) 607.

The compensator 60 may include the current source 601, the first current sinker 603, the second current sinker 605, and the analog digital converter (ADC) 607.

One current source 601, one first current sinker 603, and one second current sinker 605 are shown in FIG. 2, however it is not limited thereto, and more than one current source 601, first current sinker 603, and second current sinker 605 may be provided.

In a like manner in FIG. 2, one ADC 607 connected to the current source 601, the first current sinker 603, and the second current sinker 605 is shown, however a plurality of ADCs 607 that are respectively connected to a plurality of current sources 601, a plurality of the first current sinkers 603, and a plurality of the second current sinkers 605, or are connected into a group, may be provided.

When one of a plurality of compensator selecting switches is turned on during the sensing period, the first switch SW2 included in the current source 601 is turned on, and the current source 601 supplies first current to a data line corresponding to the turned on compensator selecting switch. The first current may be supplied to the pixel with the turned on sensing switch from among a plurality of pixels connected to the corresponding data line.

For better understanding and ease of description, the turned on compensator selecting switch will have the reference numeral of SWm, and the pixel to which the first current is supplied will have the reference numeral of 100.

The first current flows to the organic light emitting diode (OLED) through the turned on first transistor M3. In this instance, the transistors M1, M2, and M4 are turned off. A driving voltage (first voltage) of the organic light emitting diode (OLED) corresponding to the first current is supplied to the ADC 607. The first voltage supplied to the ADC 607 represents a voltage to which a deterioration degree of the organic light emitting diode (OLED) is applied.

As the organic light emitting diode (OLED) included in the pixel 100 deteriorates, resistance of the organic light emitting diode (OLED) may be increased and the driving voltage of the organic light emitting diode (OLED) may be increased according to the increase of the resistance. The deterioration degree of the organic light emitting diode (OLED) can be found by comparing the driving voltage (reference driving voltage) of the organic light emitting diode (OLED) that is not yet deteriorated when the first current is supplied and the driving voltage when the first current is supplied to the current organic light emitting diode (OLED). That is, the voltage transmitted to the ADC 607 may be converted into a digital value, and the compensator 60 can predict the deterioration degree by comparing the converted digital value with the digital value corresponding to the reference driving voltage. Driving voltage detection of the organic light emitting diode (OLED) of the pixel 100 may be performed by the current source 601 in response to turn-on of a plurality of compensator selecting switches while a plurality of detection signals may be transmitted to the corresponding sensing lines.

The first voltages of the entire pixels of the display 10 may be transmitted to the ADC 607 during the sensing period.

During the sensing period, one of a plurality of compensator selecting switches may be turned on, the transistors M1, M2, M3 and M4 may be turned on, and the second switch SW3 included in the first current sinker 603 may be turned on. The first current sinker 603 sinks the second current from the data line corresponding to the turned on compensator selecting switch. The second current may be sunk from the driving transistor M1 of the pixel with the turned on sensing switch from among a plurality of pixels connected to the corresponding data line.

For better understanding and ease of description, the turned on compensator selecting switch will have the reference numeral of SWm, and the pixel with the sunk second current will have the reference numeral of 100.

The second current may be sunk by passing through the driving transistor M1 from the first power source voltage (ELVDD) through the turned on first transistor M3. The voltage (second voltage) at the gate electrode of the driving transistor M1 may be supplied to the ADC 607. The second voltage supplied to the ADC 607 may be used to calculate the threshold voltage and mobility of the driving transistor M1.

The current value of the second current can be set variously so that a predetermined voltage may be applied within a predetermined time, and it can be particularly set as a current value corresponding to a high grayscale data voltage. Desirably, it may be set to be a current value (Imax) that will flow to the organic light emitting diode (OLED) when the pixel 100 emits light with the maximum luminance.

Second voltage detection of the driving transistor M1 of the pixel 100 may be performed by the first current sinker 603 in response to turn-on of the compensator selecting switches while a plurality of detection signals are transmitted to the corresponding sensing lines. The second voltages of the all pixels of the display 10 are detected and transmitted to the ADC 607 during the sensing period.

When one of a plurality of compensator selecting switches is turned on and the transistors M1, M2, M3 and M4 are turned on during the sensing period, the third switch SW4 included in the second current sinker 605 may be turned on and the second current sinker 605 sinks the second current from the data line corresponding to the turned on compensator selecting switch. The second current may be sunk from the driving transistor M1 of the pixel with the turned on sensing switch from among a plurality of pixels connected to the corresponding data line.

A gate voltage (third voltage) corresponding to the second current occurs at the gate electrode of the driving transistor M1, and the third voltage may be transmitted to the ADC 607. In a like manner, the threshold voltage and mobility of the driving transistor M1 of the pixel 100 may be calculated by using the third voltage.

Here, the third current may be set to be less than the second current. The third current may be set to correspond to the low grayscale data voltage.

As an exemplary embodiment, the third current may be set to be a current value corresponding to the minimum grayscale data voltage.

The third voltage detection of the driving transistor M1 of the pixel 100 may be performed by the second current sinker 605 in response to turn on of the compensator selecting switches while a plurality of detection signals may be respectively transmitted to the corresponding sensing lines. The third voltages of all the pixels of the display 10 may be detected and transmitted to the ADC 607 during the sensing period.

During the sensing period, the second voltage and the third voltage sensed for a plurality of pixels may be used to find threshold voltages and electron mobility of the driving transistors M1 included in a plurality of pixels.

The exemplary embodiment of FIG. 2 has the compensator 60 configured with two current sinkers and one current source, and without being restricted to this, one current sinker can perform sensing by differently setting the sink current value.

The ADC 607 converts the first voltage, the second voltage, and the third voltage that are respectively sensed for all pixels of the display 10 and respectively supplied from the current source 601, the first current sinker 603, and the second current sinker 605 into digital values.

Also, referring to FIG. 2, the compensator 60 may include a memory 609 and a controller 613.

The memory 609 may store the digital values of the first voltage, the second voltage, and the third voltages transmitted by the ADC 607.

The controller 613 may calculate the threshold voltages and the mobility deviation of the driving transistors M1 and the deterioration degree of the plurality of organic light emitting diodes (OLED) by using the digital information on the first voltage, the second voltage, and the third voltage sensed for the pixels. The memory 609 may store the calculated threshold voltages and mobility deviation of the driving transistors and deterioration degrees of the organic light emitting diodes (OLED's). Also, the controller 613 may control the gamma value according to the variation of the mobility deviation of the driving transistor M1. The memory 609 may store the gamma value.

As described, the memory 609 may store the threshold voltages and the mobility deviation of the driving transistors of the pixels, and the deterioration degrees and the gamma value of the organic light emitting diodes (OLEDs) per pixel.

The controller 613 may calculate a data signal compensation amount for compensating the image data signals according to the calculated threshold voltage and the mobility of the driving transistors M1, and the deterioration degrees of the organic light emitting diodes (OLED). Here, a lookup table 611 may store the data signal compensation amount for compensating the image data signals, the calculated threshold voltage and the mobility of the driving transistor M1, and the deterioration degree deviation of the organic light emitting diode (OLED), or it may store an expression for calculating the data signal compensation amount.

The timing controller 50 may transmit the image data signal Data1 of a predetermined bit for representing the grayscale of an arbitrary pixel in the video signal to the controller 613. The controller 613 may detect the information on the threshold voltage of the driving transistor, the mobility deviation, and the deterioration of the organic light emitting diode (OLED) from the memory 609, and reads the data signal compensation amount for compensating the image data signal transmitted according to the detected deviation and deterioration degree from the lookup table 611.

The controller 613 may transmit the data signal compensation amount and the gamma value to the timing controller 50, and the timing controller 50 may add the data signal compensation amount to the image data signal Data1 to generate a corrected image data signal Data2 according to the gamma value and transmit it to the data driver 30.

A method for the controller 613 to calculate a threshold voltage and mobility deviation of the driving transistor M1 will now be described in detail.

The controller 613 may calculate the threshold voltage and electron mobility of the driving transistor M1 of the pixel 100 from the voltage values.

For example, a current value of the second current may be set to be the current value Imax when the pixel emits light with the maximum luminance, a current value of the third current may be set to the current value that corresponds to a low grayscale data voltage, and it may be particularly set to be a current value 1/256 Imax that corresponds to 1/256 of Imax.

A voltage value at the gate electrode of the driving transistor M1 applied to the first node N1 of FIG. 4 when the current is sunk with the second current and the third current, that is, the voltage value V1 of the second voltage and the voltage value V2 of the third voltage are calculated as follows.

$$V_1 = ELVDD\sqrt{\frac{2I_{MAX}}{\beta}}\ |V_{thM1}| \quad \text{(Equation 1)}$$

$$V_2 = ELVDD\frac{1}{16}\sqrt{\frac{2I_{MAX}}{\beta}}\ |V_{thM1}| \quad \text{(Equation 2)}$$

Here, ELVDD of Equations 1 and 2 is the voltage value supplied by the first power source voltage ELVDD and it is the voltage at the first electrode of the driving transistor M1.

Also, β is the mobility of the electrons moving in the channel of the driving transistor M1, and |VthM1| is a proper threshold voltage of the driving transistor M1 of the pixel 100.

Therefore, the controller 613 can find the two unknown quantities, that is, the threshold voltage Q2 and mobility Q1 of the driving transistor M1.

$$Q1 = \sqrt{\frac{2I_{MAX}}{\beta}} = \frac{16}{15}(V2 - V1) \quad \text{(Equation 3)}$$

$$Q2 = |VthM1| = ELVDD - Q1 - V1 \quad \text{(Equation 4)}$$

The calculated threshold voltage and mobility of the driving transistor M1 for the respective pixels may be stored in the memory 609.

The timing controller 50 may add a corresponding data signal compensation amount to the image data signal (Data1) to correct the image data signal (Data1). The image data signal Data1 may be the digital signal in which the 8-bit digital signals representing the grayscale of one pixel are continuously arranged. The timing controller 50 may add the data signal compensation amount corresponding to the 8-bit digital signal to generate a digital signal of different bits, for example a 10-bit digital signal. The corrected image data signal Data2 becomes the signal in which the 10-bit digital signal may be continuously arranged.

The data signal compensation amount corresponding to the digital signal of the image data signal (Data1) before correction may be determined by the compensator 60 so as to compensate deterioration of the organic light emitting diode (OLED) and emit light with desired luminance irrespective of the threshold voltage and mobility deviation of the driving transistor M1.

However, when the external compensation is performed by finding the threshold voltage and mobility of the driving transistor M1 as described above, many errors occur at the intermediate grayscale so that the mura (unevenness) may be displayed in the panel.

Therefore, the compensator 60 controls the gamma (γ) according to variation of the mobility (β) of the same driving transistor M1. Variation of gamma according to mobility change may be stored in the lookup table 611 as experimental data, and the above-noted error in the intermediate grayscale may be compensated by using the gamma (γ).

When the data voltage (VDATA) is compensated by using the gamma (γ), the relationship between the image data signal (data) and the data voltage ($V_{DATA}$) is given as Equation 5.

(Equation 5)

$$V_{DATA} - ELVDD - \sqrt{\left(\frac{100}{100 - 30\frac{\alpha}{127}}\right)\left(\frac{\text{data}}{2^n - 1}\right)^{\gamma}\frac{2I_{MAX}}{\beta}} - |V_{thM1}| \quad \text{(Equation 5)}$$

ELVDD is a voltage value supplied by the first power source voltage (ELVDD) and is at the first electrode of the driving transistor M1.

Also, β is mobility of electrons moving through the channel of the driving transistor M1, and |VthM1| is a proper threshold voltage of the driving transistor M1 of the pixel 100.

Further, data represent 2-bit image data signals, and $2^{n-1}$ is the maximum value the 2-bit image data signal can have. The gamma (γ) is determined to compensate the variation of β of the same driving transistor M1 according to the change degree of the β value. |VthM1| is a proper threshold voltage of the driving transistor M1 of the pixel 100.

A process for detecting a driving voltage of the organic light emitting diode (OLED) or a gate electrode voltage of the driving transistor M1 so as to compensate the image data signal according to waveforms of FIG. 3 to FIG. 6 with reference to the circuit diagram of FIG. 2, and for the pixel 100 to emit light, will now be described.

Figure 3:
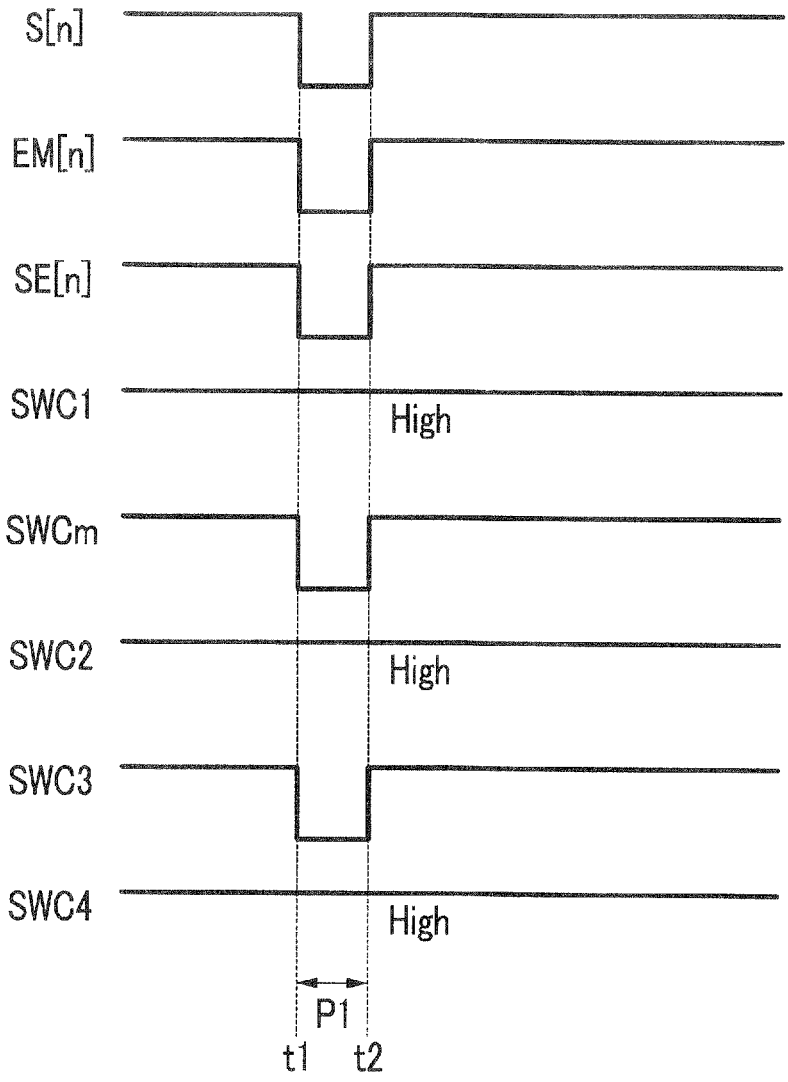
FIG. 3 to FIG. 6 are driving waveforms supplied to a pixel and a selector according to an exemplary embodiment of the present invention.
Figure 4:
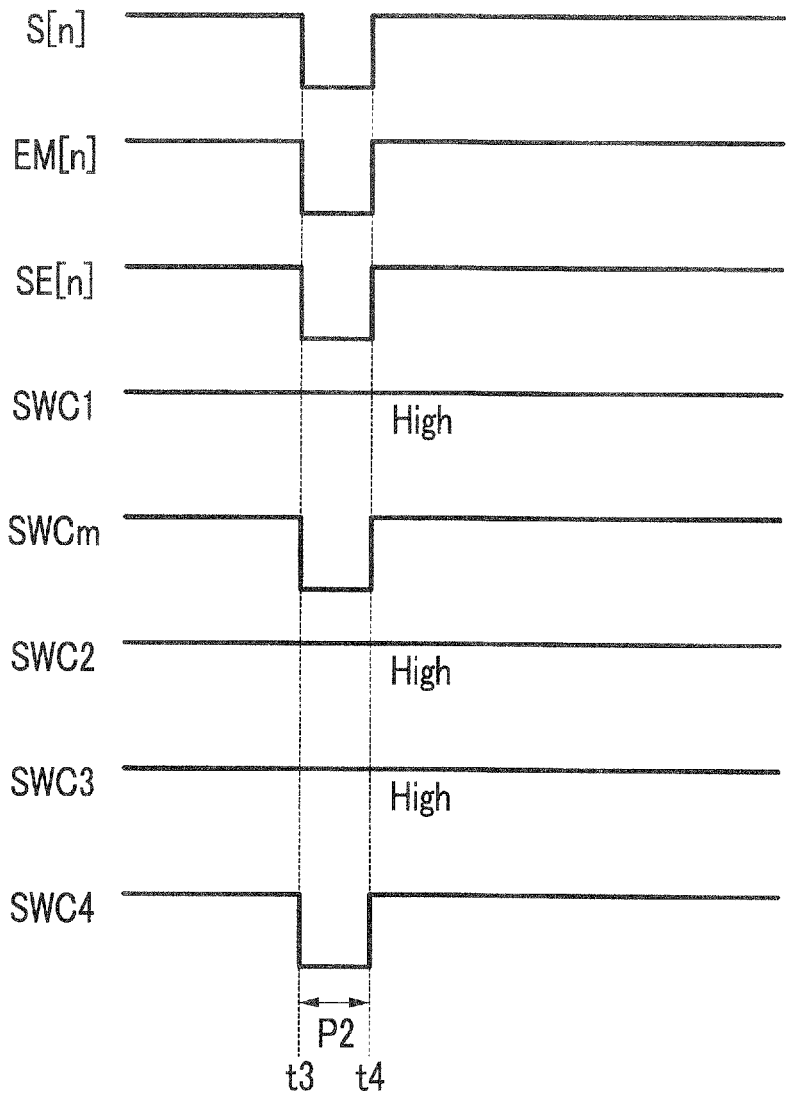
Figure 5:
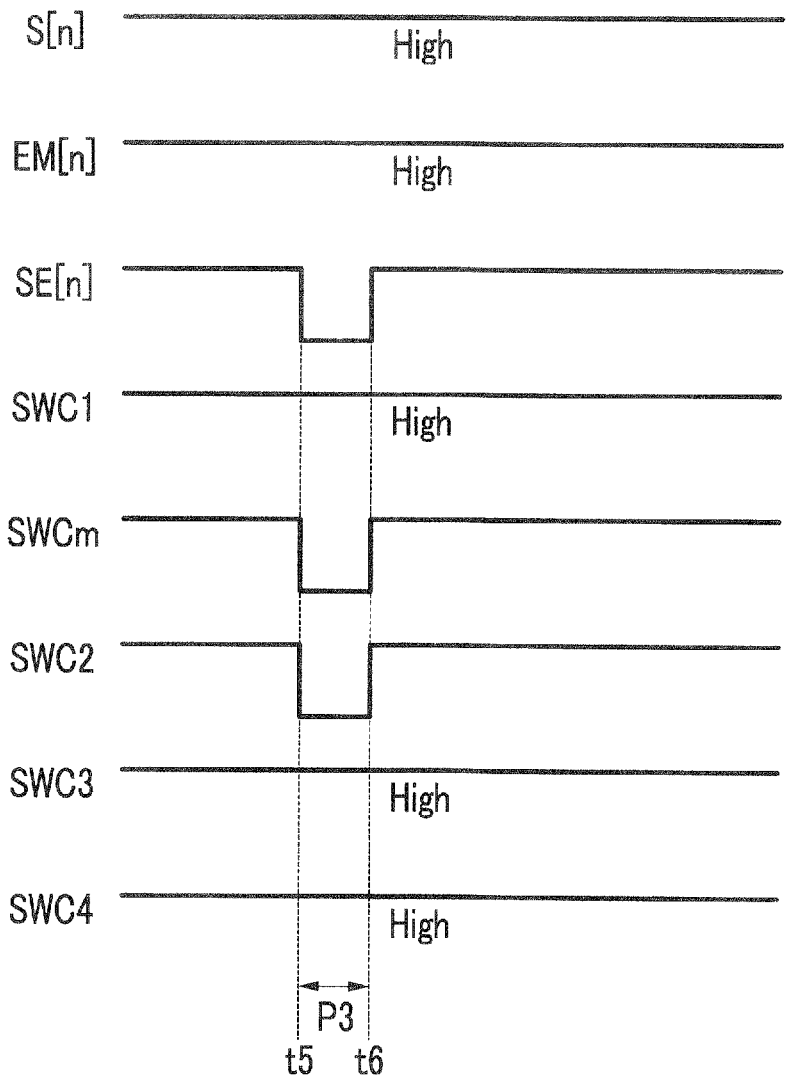
Figure 6:
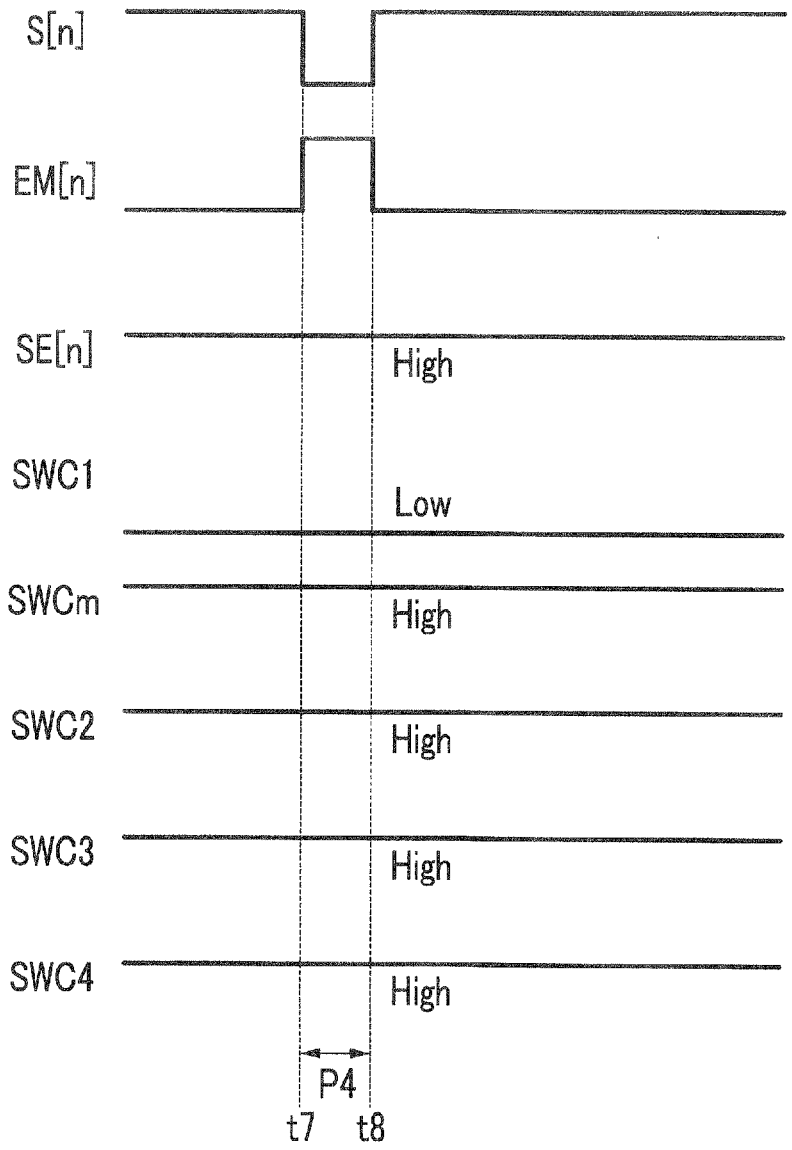

FIG. 3 is a waveform diagram for the first current sinker 603 to sense the second voltage, FIG. 4 is a waveform diagram for the second current sinker 605 to sense the third voltage, FIG. 5 is a waveform diagram for the current source 601 to sense the first voltage, while FIG. 6 is a waveform diagram for transmitting the data signal and displaying an image at the pixel 100.

The waveform diagrams shown in FIG. 3 to FIG. 6 are proposed with the case in which transistors and a plurality of selecting switches for configuring the circuit of the pixel 100 shown in FIG. 2 are PMOS transistors, and when the transistors and a plurality of selecting switches included in the circuit of the pixel 100 are created with NMOS transistors, the polarity of the waveform diagram will be reversed.

A process for sensing a voltage at the gate electrode of the driving transistor M1 of the pixel 100 according to the waveform of FIG. 3 will now be described.

At the time t1, the data selection signal SWC1 for controlling the data selecting switch SW1 connected to the data line corresponding to the pixel 100 may be transmitted as the high level that the data selecting switch SW1 is turned off. Since the compensator selection signal SWCm may be transmitted as the low level at the time t1, the compensator selecting switch SWm connected to the compensation line 73 divided from the data line corresponding to the pixel 100 is turned on.

A scan signal S[n], a light emission control signal EM[n], and a sensing signal SE[n] that are supplied to the pixel 100 may be transmitted as a low level voltage at the time t1. Accordingly, in the pixel 100, the second transistor M2 having received the scan signal S[n], the third transistor M4 having received the light emission control signal EM[n], and the first transistor M3 having received the sensing signal SE[n] may be turned on at the time t1.

During the period P1 in which the second transistor M2, the third transistor M4, and the first transistor M3 may be turned on, the second switch SW3 of the first current sinker 603 may be turned on by the low-level selection signal SWC3. The second current may be sunk through the data line connected through the turned on compensator selecting switch during this period.

Accordingly, the driving transistor M1 may be turned on to form the current path from the first power source voltage ELVDD to the cathode of the organic light emitting diode (OLED). Also, the voltage difference Vgs between the gate electrode of the driving transistor M1 and the first electrode may be formed as the voltage value corresponding to the second current, and the voltage (the second voltage) at the gate electrode of the driving transistor M1 is applied to the first node N1.

The second voltage is transmitted to the ADC 607 passing through the data line Dm connected to the pixel 100 through the second transistor M2, and may be converted into the digital value.

Referring to FIG. 4, from the time t3 to the time t4, the data selection signal SWC1 for controlling the data selecting switch SW1 is transmitted as high level and the data selecting switch SW1 is turned off. On the contrary, since the compensator selection signal SWCm may be transmitted as low level at the time t3, the compensator selecting switch SWm connected to the compensation line 73 divided from the data line corresponding to the pixel 100 is turned on.

At the time t3, the scan signal S[n], the light emission control signal EM[n], and the sensing signal SE[n] supplied to the pixel 100 may be transmitted as low level voltages to turn on the second transistor M2, the third transistor M4, and the first transistor M3 during the period P2.

Here, the third switch SW4 of the second current sinker 605 may be turned on in response to the low-level selection signal SWC4. The second current sinker 605 sinks the third current through the data line connected through the turned on compensator selecting switch SWm during the period P2.

Accordingly, the driving transistor M1 may be turned on to form the current path from the first power source voltage ELVDD to the cathode of the organic light emitting diode (OLED). Also, the voltage difference Vgs between the gate electrode of the driving transistor M1 and the first electrode may be formed as the voltage value corresponding to the third current such that the voltage (the third voltage) at the gate electrode of the driving transistor M1 is applied to the first node N1.

The third voltage may be passed through the data line Dm connected to the pixel 100 through the second transistor M2, is transmitted to the ADC 607, and may be converted into the digital value.

The memory 609 of the compensator 60 may store digital values of the converted second voltage and the third voltage, and the controller 613 may calculate the threshold voltage and the electron mobility of the driving transistor M1 of the pixel 100 from the voltage values.

The waveform diagram of FIG. 5 is the waveform diagram of the period in which the driving voltage of the organic light emitting diode (OLED) of the pixel 100 is sensed.

During the period P3 from the time t5 to the time t6, the data selection signal SWC1 is transmitted as high level to turn off the data selecting switch SW1, and the compensator selection signal SWCm is low-level, and hence, the compensator selecting switch SWm connected to the compensation line 73 divided from the data line corresponding to the pixel 100 may be turned on.

During the period P3, the scan signal S[n] and the light emission control signal EM[n] may be transmitted as a high level voltage, and the sensing signal SE[n] may be transmitted as a low level voltage.

Accordingly, the second transistor M2 having received the scan signal S[n] and the third transistor M4 having received the light emission control signal EM[n] in the pixel 100 may be turned off during the period P3, and the first transistor M3 having received the sensing signal SE[n] may be turned on during the period P3.

Here, the first switch SW2 of the current source 601 receives the low-level selection signal SWC2, and may be turned on in response thereto. The current source 601 supplies the first current to the organic light emitting diode (OLED) through the data line Dm connected through the turned on compensator selecting switch SWm during period P3.

In the case of a normal organic light emitting diode (OLED), the driving voltage applied to the anode is the appropriate voltage value corresponding to the first current, however resistance of the deteriorated organic light emitting diode (OLED) may be increased to relatively increase the driving voltage applied to the anode of the organic light emitting diode (OLED). The increased driving voltage of the organic light emitting diode (OLED) is the first voltage, and the first voltage may be transmitted to the ADC 607 passing through the turned on first transistor M3 and the data line Dm, and may be converted into a digital value.

The memory 609 may store the digital value of the first voltage, and the controller 613 may determine the data signal compensation amount for compensating by the voltage value increased by the deterioration based on the first voltage so that the organic light emitting diode (OLED) may emit light with appropriate luminance according to the data signal.

FIG. 6 is a waveform diagram for the pixel 100 to normally emit light according to the data signal.

From the time t7 to the time t8, the data selection signal SWC1 is at a low level, and the data selecting switch SW1 connected to the data line corresponding to the pixel 100 may be turned on in response thereto. On the contrary, since the compensator selection signal SWCm may be transmitted as high level during the period of the time t7 to time t8, the compensator selecting switch SWm connected to the compensation line 73 divided from the data line corresponding to the pixel 100 may be turned off.

The low-level scan signal S[n] may be supplied to the pixel 100 at the time t7, and the second transistor M2 may be turned on during the period P4.

The data driver 30 may transmit the compensated data signal to the corresponding data line Dm through the turned on data selecting switch SW1 during the period P4. The data signal may be transmitted to the first node N1 passing through the second transistor M2, and the storage capacitor Cst connected to the first node N1 charges the voltage value corresponding to the data signal.

The timing controller 50 may receive a compensation amount caused by deterioration of the organic light emitting diode (OLED) of the pixel 100 from the compensator 60 or a compensation amount for compensating a threshold voltage, mobility deviation, and mobility variation of the driving transistor M1, and increases a number of bits of the externally supplied image data signal (Data1) to generate corrected image data signal (Data2).

Figure 7:
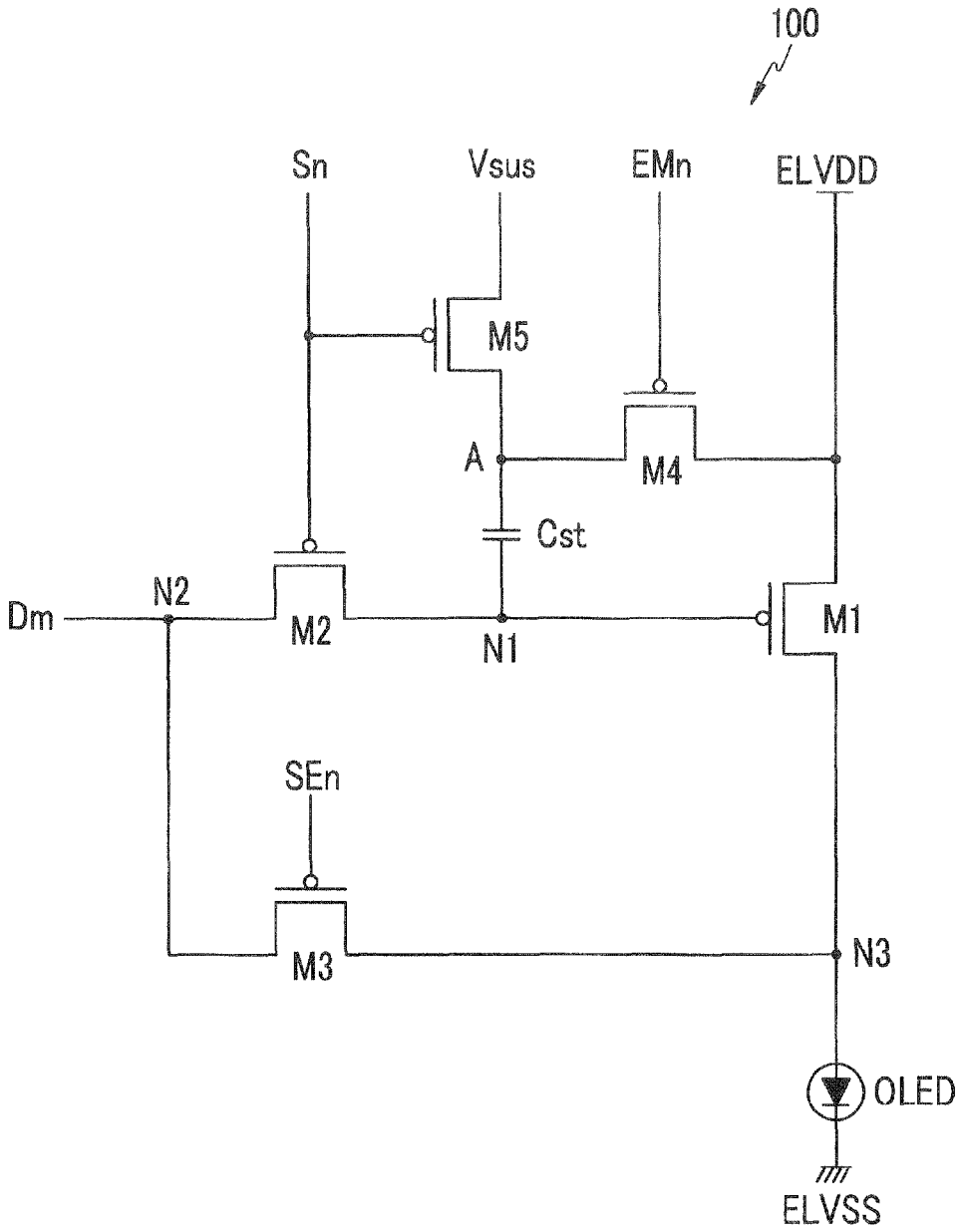
FIG. 7 is a circuit diagram of a pixel shown in FIG. 1 according to another exemplary embodiment of the present invention.
Figure 8:
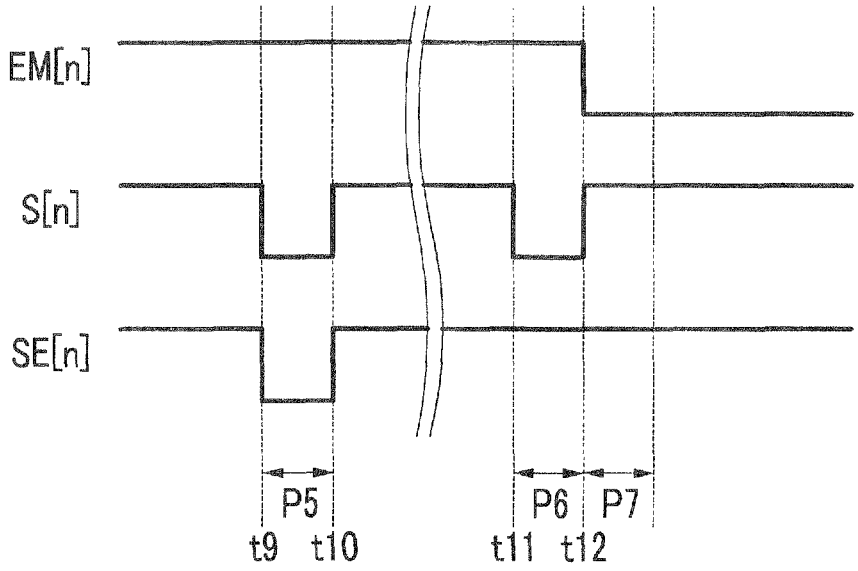
FIG. 8 is a driving waveform supplied to a pixel shown in FIG. 7 according to an exemplary embodiment of the present invention.

FIG. 7 is a circuit diagram of a pixel shown in FIG. 1 according to another exemplary embodiment, and FIG. 8 is a driving waveform of a signal supplied to the pixel.

The configuration of the pixel shown in FIG. 7 is not substantially different from that of the pixel shown in FIG. 2, and the difference thereof will be described.

Referring to FIG. 7, the pixel 100 may include an organic light emitting diode (OLED), a driving transistor M1, a first transistor M3, a second transistor M2, a third transistor M4, a fourth transistor M5, and a storage capacitor Cst.

Compared to the pixel shown in FIG. 2, the third transistor M4 having received the corresponding light emission control signal through the n-th light emission control line (EMn) is connected between the node A and another node at which the second electrode of the driving transistor M1 and the first power source voltage (ELVDD) meet.

In detail, the gate electrode of the third transistor M4 may be connected to the corresponding light emission control line (EMn) from among a plurality of light emission control lines, the first electrode may be connected to the second electrode of the driving transistor M1, and the second electrode may be connected to the node A. The third transistor M4 may be turned on when the light emission control signal with the gate on voltage level is supplied to the light emission control line (EMn), and it may be turned off in other cases. The light emission control signal may be transmitted with the gate on voltage level after the period in which a predetermined data signal may be transmitted from the data line Dm, that is, after the period in which data are written. A driving current caused by the data voltage charged in the storage capacitor Cst through the driving transistor M1 may be supplied to the organic light emitting diode (OLED) to display the image.

The storage capacitor Cst has a first end connected to the gate electrode of the driving transistor M1 and a second end connected to the first electrode of the driving transistor M1 and the first power source voltage (ELVDD).

The storage capacitor Cst may be charged with a voltage corresponding to the threshold voltage of the driving transistor M1. When the data signal is provided from the data line Dm, the voltage at the first node N1 where the first end of the storage capacitor Cst and the gate electrode of the driving transistor M1 meet is variable by the data signal. In this instance, the storage capacitor Cst may store the voltage by a voltage corresponding to the data signal transmitted from the data line Dm.

The second end of the storage capacitor Cst may be connected to the node A, and a fourth transistor M5 may be provided between the node A and the auxiliary power (Vsus).

In detail, a gate electrode of the fourth transistor M5 may be connected to the corresponding scan line (Sn) from among a plurality of scan lines, the first electrode may be connected to the auxiliary power (Vsus), and the second electrode may be connected to the node A.

The fourth transistor M5 may be turned on in response to the scan signal in the gate on voltage level transmitted through the scan line (Sn), and it may be turned off in other cases. The scan signal in the on voltage level may be supplied while the compensator 60 senses the voltage at the gate electrode of the driving transistor M1 and the driving voltage of the organic light emitting diode (OLED) and while a predetermined data signal may be transmitted from the data line Dm.

The fourth transistor M5 may be turned on corresponding to the scan signal to transmit the auxiliary voltage of the auxiliary power (Vsus) to the node A. The auxiliary voltage may be used to compensate the voltage value that falls because of the IR drop phenomenon of the first power source voltage (ELVDD).

A process for detecting the driving voltage of the organic light emitting diode (OLED) or the gate electrode voltage of the driving transistor M1 so as to compensate the image data signal according to the waveform diagram shown in FIG. 8 and emitting light by the pixel will be described with reference to the circuit diagram of the pixel 100 shown in FIG. 7.

At the time t9, the scan signal (S[n]) and the detection signal (SE[n]) as the low level voltages may be supplied to the pixel 100. Accordingly, the second transistor M2 and the fourth transistor M5 having received the scan signal (S[n]) and the first transistor M3 having received the detection signal (SE[n]) in the pixel 100 may be turned on during the period P5 from the time t9 to the time t10.

A predetermined current may be sunk from the compensator 60, the voltage difference Vgs between the gate electrode of the driving transistor M1 and the first electrode may be formed to be a voltage value corresponding to a predetermined current, and the voltage at the gate electrode of the driving transistor M1 may be applied to the first node N1. The voltage may be transmitted to the compensator 60 through the data line Dm connected to the pixel 100. Accordingly, the threshold voltage and mobility of the driving transistor M1 may be calculated and the compensation amount is determined as previously described.

FIG. 8 does not show the waveform while the driving voltage of the organic light emitting diode (OLED) of the pixel 100 is detected to compensate image sticking since it has been previously described and no detailed description thereof will be provided here.

At the time t11 after the voltage sensing process for compensation, the scan signal (S) may be applied as low level from among the control signals supplied to the pixel 100 to turn on the second transistor M2 and the fourth transistor M5 during the period P6.

During the period P6, the driving transistor M1 may be turned on, and a predetermined compensated data signal is transmitted from the corresponding data line Dm. The auxiliary voltage may be applied to the second end of the storage capacitor Cst through the fourth transistor M5 so as to charge the storage capacitor Cst by the data voltage according to the data signal and maintain a safe supply voltage of the first power source voltage (ELVDD).

At the time t12, the corresponding scan signal (S[n]) rises to high level and the corresponding light emission control signal (EM[n]) may be transmitted as a low level voltage.

Therefore, the second transistor M2 and the fourth transistor M5 may be turned off, the third transistor M4 may be turned on during the period P7 to transmit the driving current corresponding to the voltage following the data signal stored in the storage capacitor Cst to the organic light emitting diode (OLED) and emit the organic light emitting diode (OLED).

Figure 9:
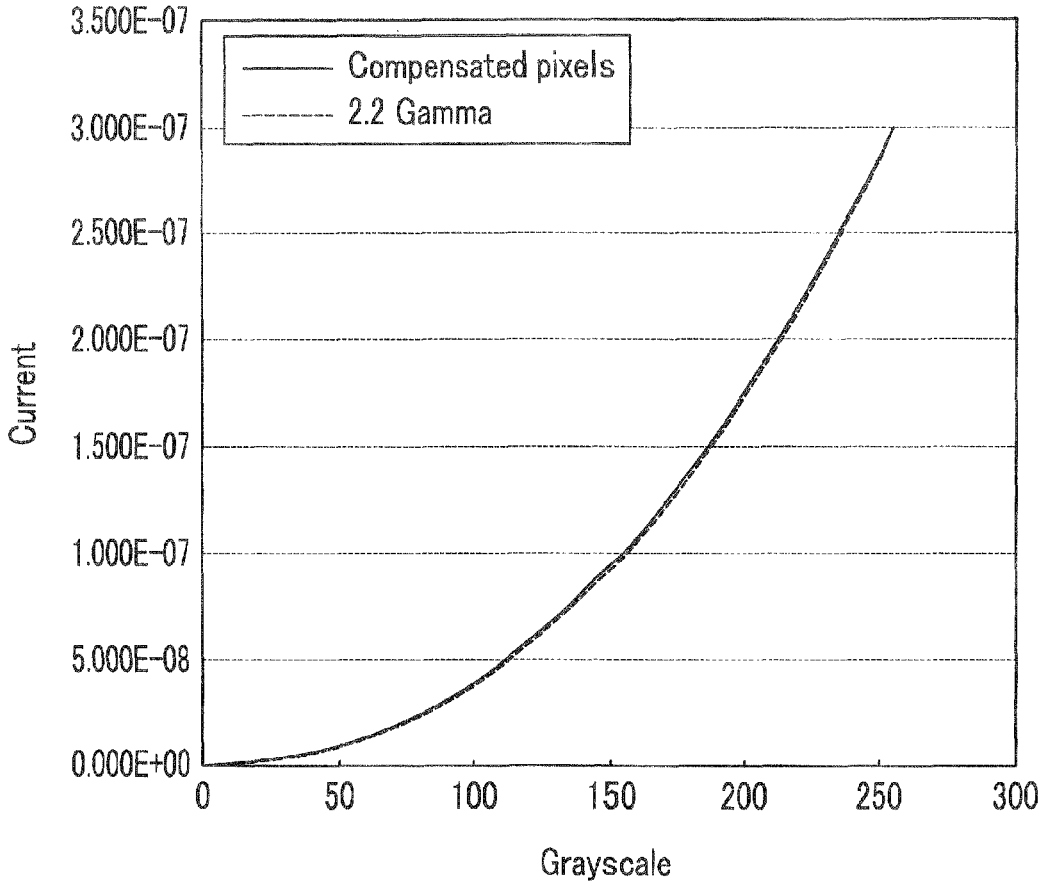
FIG. 9 is a graph of current curves for grayscales in an organic light emitting diode (OLED) display according to an exemplary embodiment of the present invention.

FIG. 9 is a graph of current curves for respective grayscales of an organic light emitting diode (OLED) display according to an exemplary embodiment of the present invention.

The graph of FIG. 9 shows the result generated by performing image sticking compensation and compensation for uniform luminance, correcting a deviation caused by mobility non-uniformity, and eliminating an error from the data voltage in the organic light emitting diode (OLED) display.

Referring to FIG. 9, the current curve per grayscale of the pixel image emitting light according to the data signal with the corrected image data signal according to an exemplary embodiment of the present invention matches the 2.2 gamma curve and sufficiently expresses the low grayscale data area.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Also, the material of respective constituent elements described in the specification can be easily selected and substituted from various materials by a person of ordinary skill in the art. Further, a person of ordinary skill in the art can omit part of the constituent elements described in the specification without deterioration of performance or can add constituent elements for better performance. In addition, a person of ordinary skill in the art can change the specification depending on the process conditions or equipment. Hence, the range of the present invention is to be determined by the claims and equivalents.

What is claimed is:

1. An organic light emitting diode display, comprising:

a plurality of pixels including a plurality of organic light emitting diodes and a plurality of driving transistors for supplying a driving current to the respective organic light emitting diodes;

a compensator for receiving a predetermined voltage applied to a gate electrode of the respective driving transistors, finding a threshold voltage, mobility, and a change of mobility of the driving transistors, and determining a compensation amount caused by an input image data signal based on said threshold voltage, said mobility and said mobility deviation while sinking a predetermined current to a path of a driving current to the organic light emitting diode through a data line connected to the pixels, and controlling a gamma according to the change of the mobility;

a timing controller for receiving the compensation amount, correcting the input image data signal, and transmitting the corrected image data signal; and a data driver for generating a data voltage based on the corrected image data signal and the gamma, and supplying the data voltage to the pixels.

2. The organic light emitting diode display of claim 1, wherein the compensator further comprises:

at least one current sinker for sinking the predetermined current;

a controller for finding the threshold voltage, mobility, and mobility deviation, and determining the compensation amount; and a memory for receiving and storing the predetermined voltage, and storing the determined compensation amount.

3. The organic light emitting diode display of claim 2, wherein the current sinker further comprises:

a first current sinker for sinking a predetermined first current; and a second current sinker for sinking a second current having a current value that is less than the first current.

4. The organic light emitting diode display of claim 3, wherein the first current represents a current value flowing to the organic light emitting diode when the organic light emitting diode emits light with the maximum luminance.

5. The organic light emitting diode display of claim 3, wherein a first voltage and a second voltage are applied to each gate electrode of a plurality of driving transistors while the first current and the second current are sunk, and each of the threshold voltage and mobility of the driving transistors are calculated from the first voltage and the second voltage.

6. The organic light emitting diode display of claim 1, wherein the compensator receives each driving voltage of the organic light emitting diodes through corresponding data lines while supplying a predetermined third current to the organic light emitting diodes through the data lines connected to the pixels, and determines a compensation amount caused by each deterioration degree of the organic light emitting diodes according to the driving voltages.

7. The organic light emitting diode display of claim 6, wherein the compensation amount represents a voltage value corresponding to the driving voltage that is increased by deterioration of the organic light emitting diodes.

8. The organic light emitting diode display of claim 6, wherein the compensator further comprises a current source for supplying the third current.

9. The organic light emitting diode display of claim 1, wherein the organic light emitting diode display further comprises a selector between the compensator, the data driver, and the pixels, and the selector comprise:

a plurality of data selecting switches connected to data lines connected to the pixels;

a plurality of compensator selecting switches connected to a node of a plurality of compensation lines divided by the data lines; and a selecting driver for generating and transmitting a plurality of selection signals for controlling the data selecting switches and the compensator selecting switches.

10. The organic light emitting diode display of claim 1, wherein the pixels respectively comprise:

a plurality of first transistors provided between electrodes of the organic light emitting diodes and the data lines connected to the pixels; and a plurality of second transistors provided between the data lines connected to the pixels and the gate electrodes of the driving transistors.

11. The organic light emitting diode display of claim 10, wherein while the first transistors and the second transistors are turned on, a predetermined current is sunk and a predetermined voltage applied to the gate electrodes of the driving transistors is transmitted to the compensator.

12. The organic light emitting diode display of claim 10, wherein while the first transistors are turned on and the second transistors are turned off, a predetermined current is supplied and the driving voltages of the organic light emitting diodes are transmitted to the compensator.

13. The organic light emitting diode display of claim 10, wherein while the first transistors are turned off and the second transistors are turned on, the data voltage based on the corrected image data signal is supplied to a plurality of pixels.

14. A method for driving an organic light emitting diode display, comprising:

receiving a predetermined voltage applied to gate electrodes of a plurality of driving transistors while sinking a predetermined current to a path of a driving current to an organic light emitting diode by passing through the driving transistors included in the pixels through data lines corresponding to the pixels;

finding threshold voltage, mobility, and mobility deviation of the driving transistors based upon the predetermined voltage, and determining a compensation amount caused by an input image data signal based on said threshold voltage, said mobility and said mobility deviation;

controlling a gamma according to the change of the mobility; and correcting the input image data signal based on the compensation amount, generating a data voltage according to the corrected image data signal and the gamma, and transmitting the data voltage to the pixels.

15. The method of claim 14, wherein the receiving of a predetermined voltage comprises:

sinking a first current, and receiving a first voltage applied to gate electrodes of the driving transistors; and sinking a second current having a current value that is less than the first current, and receiving a second voltage applied to the gate electrodes of the driving transistors.

16. The method of claim 15, wherein the first current indicates a current value flowing to the organic light emitting diode when the organic light emitting diode emits light with the maximum luminance.

17. The method of claim 14, further comprising, before or after the receiving of a predetermined voltage, supplying a predetermined third current to a plurality of organic light emitting diodes included in the pixels through the data lines corresponding to the pixels, and receiving driving voltages of the organic light emitting diodes; and determining a compensation amount caused by deterioration degrees of the organic light emitting diodes according to the received driving voltage.

18. The method of claim 14, wherein the receiving of a predetermined voltage through data lines corresponding to the pixels and transmitting the data voltage caused by the corrected image data signal to the pixels are controlled by a switching operation of a selector including a plurality of data selecting switches connected to the data lines and a plurality of compensator selecting switches connected to a node of a plurality of compensation lines divided by the data lines.

19. The method of claim 18, wherein the selector further comprises a selecting driver for generating and transmitting a plurality of selection signals for controlling switching operations of the data selecting switches and the compensator selecting switches.

20. The method of claim 14, wherein, while the receiving of a predetermined voltage is performed, driving transistors of the pixels, first transistors of the pixels connected between electrodes of the organic light emitting diodes and the corresponding data lines, and second transistors of the pixels connected between the corresponding data lines and gate electrodes of the driving transistors are turned on.

21. The method of claim 14, wherein, while the generating and transmitting of a data voltage caused by the corrected image data signal to a plurality of pixels is performed, first transistors of the pixels connected between electrodes of the organic light emitting diodes and the corresponding data lines are turned off, and the driving transistors of the pixels and second transistors of the pixels connected between the corresponding data lines, and the gate electrodes of the driving transistors are turned on.

* * * * *